US011358203B2

(12) United States Patent
Natori et al.

(10) Patent No.: US 11,358,203 B2
(45) Date of Patent: Jun. 14, 2022

(54) METHOD FOR PRODUCING PRESS-FORMED PRODUCT

(71) Applicant: NIPPON STEEL & SUMITOMO METAL CORPORATION, Tokyo (JP)

(72) Inventors: Junki Natori, Tokyo (JP); Yoshiaki Nakazawa, Tokyo (JP); Ryuichi Nishimura, Tokyo (JP); Keiji Ogawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 172 days.

(21) Appl. No.: 16/088,947

(22) PCT Filed: Apr. 3, 2017

(86) PCT No.: PCT/JP2017/013982
§ 371 (c)(1),
(2) Date: Sep. 27, 2018

(87) PCT Pub. No.: WO2017/175730
PCT Pub. Date: Oct. 12, 2017

(65) Prior Publication Data

US 2019/0111463 A1 Apr. 18, 2019

(30) Foreign Application Priority Data

Apr. 4, 2016 (JP) ..... JP2016-074866

(51) Int. Cl.
*B21D 22/20* (2006.01)
*B21D 22/26* (2006.01)
(Continued)

(52) U.S. Cl.
CPC ..... *B21D 22/26* (2013.01); *B21D 5/01* (2013.01); *B21D 22/20* (2013.01); *B21D 24/06* (2013.01)

(58) Field of Classification Search
CPC ..... B21D 24/005; B21D 24/06; B21D 22/21; B21D 22/20; B21D 22/24; B21D 22/26;
(Continued)

(56) References Cited

U.S. PATENT DOCUMENTS 9,511,403 B2 * 12/2016 Yonemura ..... B21D 22/30
9,718,113 B2 * 8/2017 Nakata ..... B21D 22/26
(Continued)

FOREIGN PATENT DOCUMENTS

FR 3010921 B1 * 2/2016 ..... B21D 22/30
JP 2008-018442 1/2008
(Continued)

*Primary Examiner* — Debra M Sullivan
(74) *Attorney, Agent, or Firm* — Clark & Brody LP

(57) ABSTRACT

A method for producing a press-formed product includes a first pressing step and a second pressing step. In the first pressing step, an intermediate formed product is formed from a processed material by using first press tooling. The intermediate formed product includes a stepped section of a top plate section, a temporary vertical wall section adjacent to the top plate section via a ridge section and having at least part of the shape of the vertical wall section, and a temporary flange section adjacent to the temporary vertical wall section via a temporary ridge section. In the second pressing step, the press-formed product is formed from the intermediate formed product. In the second pressing step, forming is performed such that the temporary ridge section is moved toward the temporary flange section with at least part of the top plate section of the intermediate formed product restricted.

8 Claims, 11 Drawing Sheets

(51) Int. Cl.
*B21D 24/06* (2006.01)
*B21D 5/01* (2006.01)

(58) Field of Classification Search
CPC ..... B21D 22/30; B21D 5/01; B21D 53/88; B21D 22/22
USPC ..... 72/349, 348
See application file for complete search history.

(56) References Cited

U.S. PATENT DOCUMENTS

| | | | | |
|---|---|---|---|---|
| 9,839,954 | B2 * | 12/2017 | Miyagi | B21D 47/01 |
| 2011/0016945 | A1 | 1/2011 | Nakao et al. | |
| 2013/0239645 | A1 * | 9/2013 | Tanaka | B21D 22/02 72/361 |

FOREIGN PATENT DOCUMENTS

| | | | | |
|---|---|---|---|---|
| JP | 2008018442 | A | * | 1/2008 |
| JP | 2013-049077 | | | 3/2013 |
| JP | 2013049077 | A | * | 3/2013 |
| JP | 2014-240078 | | | 12/2014 |
| WO | 2011/145679 | | | 11/2011 |
| WO | 2014/050973 | | | 4/2014 |

* cited by examiner

METHOD FOR PRODUCING PRESS-FORMED PRODUCT

TECHNICAL FIELD

The present disclosure relates to a method for producing a press-formed product and a production line thereof. The present disclosure relates more particularly to a method for producing a press-formed product used in an automobile and a production line of the press-formed product.

BACKGROUND ART

A frame part (pillar, for example) of an automobile or any other part is produced by press-forming a metal plate, such as a steel plate. A frame part of an automobile or any other part has a groove-like or hat-like cross-sectional shape to ensure the strength of the part. A frame part of an automobile or any other part may have a stepped section as part of a top plate section that allows, for example, another part to be attached thereto. When a blank material is press-formed into a part having a stepped section as part of a top plate section, wrinkles occur on a formed part in some cases. To avoid the occurrence of the wrinkles, a part having a stepped section as part of a top plate section may be formed in draw forming. The stepped section means an inclining area that connects areas having heights different from the height of the stepped section to each other, and the inclination angle is not limited to 90°.

In recent years, an automobile is required to have a lighter vehicle body for improvement in fuel consumption, which contributes to prevention of global warming. Further, improvement in safety at the time of a crush accident is required. From these requirements, a metal plate having high tensile strength is used as the blank material of a frame part or any other part.

A high-strength metal plate, however, tends to crack during draw forming. A reason for this is that a high-strength metal plate has low ductility.

Japanese Patent Application Publication No. 2014-240078 (Patent Literature 1) discloses a production method for avoiding wrinkles of a press-formed product. WO 2011/145679 (Patent Literature 2) discloses a production method for avoiding wrinkles and cracks of a press-formed product.

Patent Literature 1 discloses a method for producing a press-formed product in draw forming in such a way that the press-formed product has an L-letter shape with no wrinkles. In the production method disclosed in Patent Literature 1, the press forming is performed such that an area bent in the L-letter shape is restricted with a pad. Patent Literature 1 describes that the method prevents wrinkles from occurring in the area bent in the L-letter shape.

Patent Literature 2 discloses a method for producing a press-formed product bent in an L-letter or T-letter shape by using bend forming. In the production method disclosed in Patent Literature 2, the bent area of the press-formed product is formed with part of a top plate section of the press-formed product restricted with a pad. Patent Literature 2 describes that the method prevents wrinkles from occurring in the area bent in the L-letter or T-letter shape.

CITATION LIST

Patent Literature

Patent Literature 1: Japanese Patent Application Publication No. 2014-240078

Patent Literature 2: WO 2011/145679

SUMMARY OF INVENTION

Technical Problem

The production methods disclosed in Patent Literatures 1 and 2 are, however, each directed to production of a press-formed product bent in an L-letter shape or any other shape. Patent Literatures 1 and 2 therefore do not disclose production of a press-formed product with a top plate section having a stepped section.

An objective of the present disclosure is to provide a production method and a production line capable of avoiding a wrinkle or crack in a press-formed product with a top plate section having a stepped section produced by using a high-strength metal plate.

Solution to Problem

A press-formed product produced by using a production method according to an embodiment of the present invention includes a top plate section and a vertical wall section. The top plate section has a stepped section in a longitudinal direction on the top plate section. The stepped section extends from a widthwise end section of the top plate section and crosses at least widthwise part of the top plate section. The vertical wall section is adjacent to the top plate section via a ridge section located in the widthwise end section of the top plate section that is an end section where the stepped section is located.

The method for producing a press-formed product according to a present embodiment includes a first pressing step and a second pressing step. In the first pressing step, an intermediate formed product is formed from a processed material by using first press tooling. The intermediate formed product includes the stepped section of the top plate section, a temporary vertical wall section adjacent to the top plate section via the ridge section and having at least part of a shape of the vertical wall section, and a temporary flange section adjacent to the temporary vertical wall section via a temporary ridge section located in an end section of the temporary vertical wall section that is an end section opposite to the ridge section. In the second pressing step, the press-formed product is formed from the intermediate formed product by using second press tooling. In the second pressing step, forming is performed such that the temporary ridge section is moved toward the temporary flange section with at least part of the top plate section of the intermediate formed product restricted.

A production line according to the present embodiment includes a first press machine and a second press machine disposed on a downstream side of the first press machine. The first press machine includes a first punch, a first die, and a first pad. The first punch includes a first top section, a first punch wall section, and a punch flat section. The first top section has a stepped section in a longitudinal direction that extends from a widthwise end section of the first punch and crosses at least widthwise part of the first punch. The first punch wall section is adjacent to the first top section via a first punch shoulder that is located in an end section of the first top section that is an end section where the stepped section exists. The punch flat section is adjacent to the first punch wall section via a punch bottom shoulder. The first die faces the first punch shoulder, the first punch wall section, and the punch flat section of the first punch. The first pad faces the first top section of the first punch. The second press machine includes a second punch, a second die, and a second pad. The second punch has a second top section and a second punch wall section. The second top section has a same shape as a shape of the first top section. The second punch wall section is adjacent to the second top section via a second punch shoulder that is located in an end section of the second top section that is an end section where the stepped section exists. The second die faces the second punch shoulder and the second punch wall section of the second punch. The second pad faces the second top section of the second punch. A height of the second punch wall section in the second press machine is greater than a height of the first punch wall section in the first press machine. The "height" in the present disclosure means the size in the height direction unless the positional relationship between the first and second press machines is otherwise referred to.

Advantageous Effects of Invention

The production method according to the present disclosure allows occurrence of a wrinkle or crack to be avoided even when a press-formed product with a top plate section having a stepped section is produced by using a high-strength metal plate.

DESCRIPTION OF EMBODIMENTS

Figure 1:
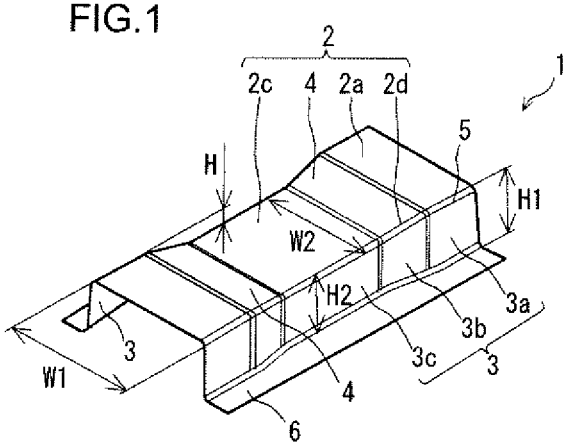
FIG. 1 is a perspective view of a press-formed product produced by using a production method according to an embodiment of the present invention.

A press-formed product produced by using a production method according to an embodiment of the present invention includes a top plate section and a vertical wall section. The top plate section has a stepped section in a longitudinal direction on the top plate section. The stepped section extends from a widthwise end section of the top plate section and crosses at least widthwise part of the top plate section. The vertical wall section is adjacent to the top plate section via a ridge section located in the widthwise end section of the top plate section that is an end section where the stepped section is located.

The method for producing a press-formed product according to the present embodiment includes a first pressing step and a second pressing step. In the first pressing step, an intermediate formed product is formed from a processed material by using first press tooling. The intermediate formed product includes the stepped section of the top plate section, a temporary vertical wall section adjacent to the top plate section via the ridge section and having at least part of the shape of the vertical wall section, and a temporary flange section adjacent to the temporary vertical wall section via a temporary ridge section located in an end section of the temporary vertical wall section that is an end section opposite to the ridge section. In the second pressing step, the press-formed product is formed from the intermediate formed product by using second press tooling. In the second pressing step, forming is performed such that the temporary ridge section is moved toward the temporary flange section with at least part of the top plate section of the intermediate formed product restricted.

In the production method according to the present embodiment, the processed material is press-formed in the two different steps. In the first step, the intermediate formed product, which is a partly finished press-formed product (finished product) corresponding to part of the height thereof, is produced. The intermediate formed product includes the temporary flange section. To form the temporary flange section as part of the intermediate formed product, press tooling restricts an area of the processed material that is the area corresponding to the temporary flange section. As a result, no material flow occurs in the temporary flange section when the press forming advances. Therefore, in the intermediate formed product, shearing strain that causes wrinkles is not induced as compared with a press-formed product formed in only one pressing step. When the intermediate formed product produced in the first step is used to form the remainder in the second step, no shearing strain is induced in the press-formed product (finished product) as compared with the forming using only one pressing step. A reason for this is that only a small amount of shearing strain is induced in the intermediate formed product. Wrinkles are therefore unlikely to occur on the press-formed product.

The height of the temporary vertical wall section adjacent to the top plate section lower than the stepped section (below stepped section) of the intermediate formed product is preferably 50% of the height of the vertical wall section of the press-formed product or less. The amount of shearing strain increases as the press forming advances, as described above. Therefore, when the height of the formed product in the first step is smaller than the height of the formed product in the second step, the shearing strain in the intermediate formed product produced in the first step can be effectively reduced. It is further preferable that the entire area of the ridge section of the press-formed product is formed in the first pressing step.

A processed material having low tensile strength tends to be plastically deformed. Even in an area where wrinkles occur when a processed material having high tensile strength is press-formed by using press tooling, wrinkles are unlikely to occur when a processed material having low tensile strength is press-formed because the processed material having low tensile strength is plastically deformed and therefore follows the shape of the press tooling. Wrinkles therefore cause no particular problem in many cases in the press forming of a processed material having low tensile strength. On the other hand, wrinkles tend to occur on a processed material having high tensile strength because the processed material having high tensile strength is unlikely to be plastically deformed. The production method according to the present embodiment is therefore particularly effective in the case where a high-strength processed material is formed. Specifically, in the production method described above, the tensile strength of the processed material is preferably 590 MPa or more. The tensile strength of the processed material is more preferably 980 MPa or more.

The greater the height of the stepped section of the press-formed product, the larger the wrinkles that occur. In the production method described above, the forming can be performed with no wrinkle even under the condition which causes wrinkles to be likely to occur and in which the height H of the stepped section of the press-formed product and the radius of curvature R of the ridge section of the press-formed product satisfy the following Formula (1):

$$H \gtrsim 0.4R \quad (1)$$

A production line according to the present embodiment includes a first press machine and a second press machine disposed on the downstream side of the first press machine.

The first press machine has the following configuration (1) or (2):

(1) The first press machine includes a first punch, a first die, and a first pad. The first punch includes a first top section, a first punch wall section, and a punch flat section. The first top section has a stepped section in a longitudinal direction that extends from a widthwise end section of the first punch and crosses at least widthwise part of the first punch. The first punch wall section is adjacent to the first top section via a first punch shoulder that is located in an end section of the first top section that is an end section where the stepped section exists. The punch flat section is adjacent to the first punch wall section via a punch bottom shoulder. The first die faces the first punch shoulder, the first punch wall section, and the punch flat section of the first punch. The first pad faces the first top section of the first punch. The first pad is shaped such that the convex/concave shape of the first top section is reversed. The term "faces" in the following description refers to a state in which the shapes of a pair of press tooling sets are reversed from each other in addition to the positional relationship between the pair of press tooling sets, as described above. That is, in a case where one of the pair of press tooling sets has a convex shape, the other press tooling that faces the one press tooling has a concave shape.

(2) The first press machine includes a first punch, a blank holder, and a first die. The first punch includes a first top section and a first punch wall section. The first top section has a stepped section in a longitudinal direction that extends from a widthwise end section of the first punch and crosses at least widthwise part of the first punch. The first punch wall section is adjacent to the first top section via a first punch shoulder that is located in an end section of the first top section that is an end section where the stepped section exists. The blank holder is adjacent to the first punch. The first die faces the first punch and the blank holder.

The second press machine includes a second punch, a second die, and a second pad. The second punch includes a second top section and a second punch wall section. The second top section has the same shape as the shape of the first top section. The second punch wall section is adjacent to the second top section via a second punch shoulder that is located in an end section of the second top section that is an end section where the stepped section exists. The second die faces the second punch shoulder and the second punch wall section of the second punch. The second pad faces the second top section of the second punch. The height of the second punch wall section in the second press machine is greater than the height of the first punch wall section in the first press machine.

[Press-Formed Product]

Figure 22:
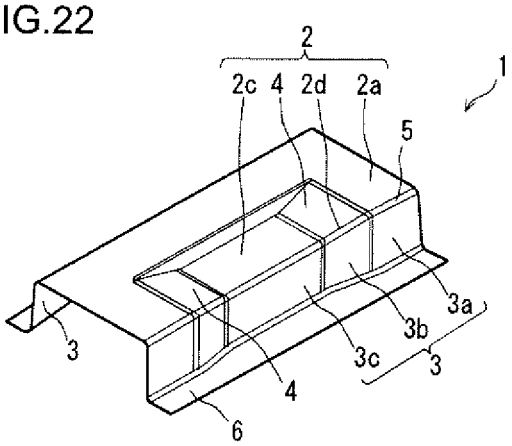
FIG. 22 is a perspective view showing another example of the press-formed product in the present embodiment.

FIG. 1 is a perspective view of a press-formed product produced by using the production method according to the present embodiment. For ease of description, it is assumed that the side where a top plate section 2 exists is called an upper side, and that the side where flange sections 6 exist is called a lower side. A press-formed product 1 includes the top plate section 2 and vertical wall sections 3. The top plate section 2 includes stepped sections 4 in the longitudinal direction, top plate sections 2*a* above the stepped sections, and a top plate section 2*c* below the stepped sections. The top plate sections 2*a* above the stepped sections are connected to the stepped sections 4. The stepped sections 4 are connected to the top plate section 2*c* below the stepped sections. The stepped sections 4 extend from widthwise end sections 2*d* of the top plate section 2. FIG. 1 shows a case where the stepped sections 4 exist over the entire widthwise area of the press-formed product 1. The stepped sections 4 may not, however, exist over the entire widthwise area of the press-formed product 1, and the stepped sections 4 only need to cross at least widthwise part of the press-formed product 1 (FIG. 22, for example). The end sections 2*d* of the top plate section 2 form ridge sections 5. The ridge sections 5 each have a rounded contour. The following description will be made of a case where the material to be processed is a metal plate.

Vertical wall sections 3 are adjacent to the top plate section 2 via the ridge sections 5. The vertical wall sections 3 each include vertical wall sections 3*a* immediately below the portions above the stepped sections, vertical wall sections 3*b* immediately below the stepped sections, and a vertical wall section 3*c* immediately below the portion below the stepped sections. The vertical wall sections 3*a* immediately below the portions above the stepped sections are adjacent to the top plate sections 2*a* above the stepped sections via the ridge sections 5. The vertical wall sections 3*b* immediately below the stepped sections are adjacent to the stepped sections 4 of the top plate section 2 via the ridge sections 5. The vertical wall section 3*c* immediately below the portion below the stepped sections is adjacent to the top plate section 2*c* below the stepped sections via the ridge sections 5.

Figure 21:
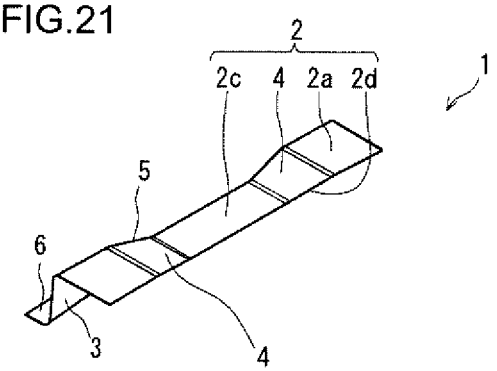
FIG. 21 is a perspective view showing an example of the press-formed product in the present embodiment.

FIG. 1 shows a case where the press-formed product 1 has a hat-like cross-sectional shape perpendicular to the longitudinal direction. The press-formed product 1 therefore includes flange sections 6. The press-formed product 1, however, does not necessarily have a hat-like cross-sectional shape. Specifically, the press-formed product 1 may have a half-hat shape having only one flange section 6 or may have a groove shape in which the flange sections 6 coincide with the vertical wall sections during the forming process. The press-formed product 1 may not have, for example, a hat shape or may have a shape that is half the shape described above (see FIG. 21). The stepped sections 4 may not cross the top plate section 2 (see FIG. 22). Further, the press-formed product 1 may have one stepped section 4 or may have three or four stepped sections 4. That is, an arbitrary number of stepped sections may exist.

When a press-formed product 1 with the top plate section 2 having the stepped sections 4, such as that shown in FIG. 1, undergoes bend forming in only one step, wrinkles are likely to occur on the vertical wall sections 3*b* immediately below the stepped sections and the vertical wall sections 3*c* immediately below the portion below the stepped sections. The mechanism in accordance with which the wrinkles occur will be described later. The occurrence of wrinkles of a press-formed product relates to the height H of the stepped sections of the top plate section and the radius of curvature R of the cross section of each of the ridge sections 5 of the press-formed product. The greater the height H of the stepped sections of the top plate section, the larger the wrinkles that occur. The smaller the radius of curvature R of the cross section of each of the ridge sections, the larger the wrinkles that occur.

The present inventors have conducted a simulation to study the relationship of the height H of the stepped sections of the top plate section of the press-formed product and the radius of curvature R of each of the ridge sections of the press-formed product with the size of the wrinkles.

Figure 2:
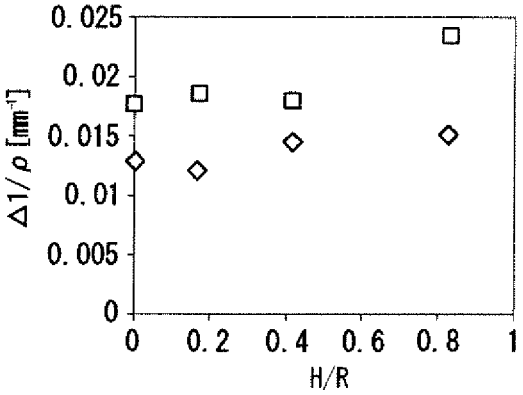
FIG. 2 shows the relationship between the size of wrinkles in a case where a press-formed product, such as that shown in FIG. 1, undergoes bend forming in only one step and the shape of a stepped section.

FIG. 2 shows the size of the wrinkles in the case where a press-formed product, such as that shown in FIG. 1, undergoes bend forming in only one step. The ordinate of FIG. 2 represents the difference $\Delta 1/\rho$ between the maximum and minimum of the primary curvature. The abscissa of FIG. 2 represents the ratio H/R between the height H of stepped sections of a top plate section of the press-formed product and the radius of curvature R of the ridge sections of the press-formed product. In the simulation shown in FIG. 2, the ratio H/R between the height H of stepped sections of a top plate section of the press-formed product, such as that shown in FIG. 1, and the radius of curvature R of the ridge sections of the press-formed product was variously changed. Further, in the simulation shown in FIG. 2, JAC270DC and JSC980Y defined in the Japan Iron and Steel Federation standard were used as the material to be processed. The square marks in FIG. 2 represent results associated with JAC270DC, and the rhombus marks represent results associated with JSC980Y.

In the simulation shown in FIG. 2, the study was conducted on the primary curvature $1/\rho$ at an arbitrary point on the vertical wall sections 3*c* immediately below the portion below the stepped portions of the press-formed product. The difference $\Delta 1/\rho$ between the maximum and minimum of the primary curvature $1/\rho$ was calculated and used as an index of evaluation of the wrinkles. FIG. 2 shows that the greater the $\Delta 1/\rho$, the larger the wrinkles having occurred. In the region where the ratio H/R is smaller than 0.4, the value of $\Delta 1/\rho$ does not greatly change, whereas in the region where the ratio H/R is 0.4 or more, however, the value of $\Delta 1/\rho$ increases or the wrinkles occurred markedly as compared with the region where the ratio H/R is smaller than 0.4, as shown in FIG. 2. The primary curvature was calculated by the same method as that described in Examples, which will be described later.

To avoid the occurrence of the wrinkles on the vertical wall sections 3*b* immediately below the stepped sections and the vertical wall sections 3*c* immediately below the portion below the stepped portions of the press-formed product, draw forming is suitable, as described above. However, since a high-strength metal plate tends to crack during draw forming, the shape of a press-formed product to which the present disclosure is directed cannot be formed in only one draw forming. The present inventors have therefore examined a production method capable of avoiding occurrence of wrinkles on the vertical wall sections 3*b* immediately below the stepped sections and the vertical wall sections 3*c* immediately below the portion below the stepped sections even in the case where a high-strength metal plate is press-formed in bend forming.

The present inventors studied the size of the wrinkles in the case where a press-formed product with a top plate section having stepped sections (hereinafter also simply referred to as "press-formed product") is formed in only one bend forming process. Specifically, the shape of a processed material during the press forming was studied in a simulation using a finite element method (FEM).

Figure 3:
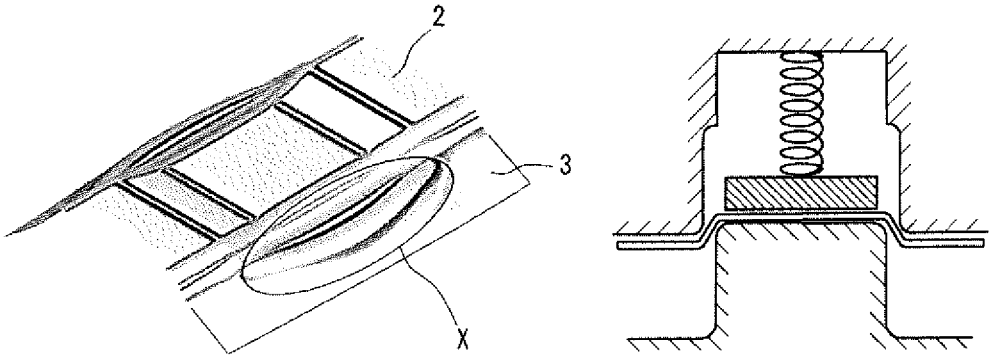
FIG. 3 shows the shape of a processed material in an initial stage of press forming in the case where the press forming is performed in only one step.
Figure 4:
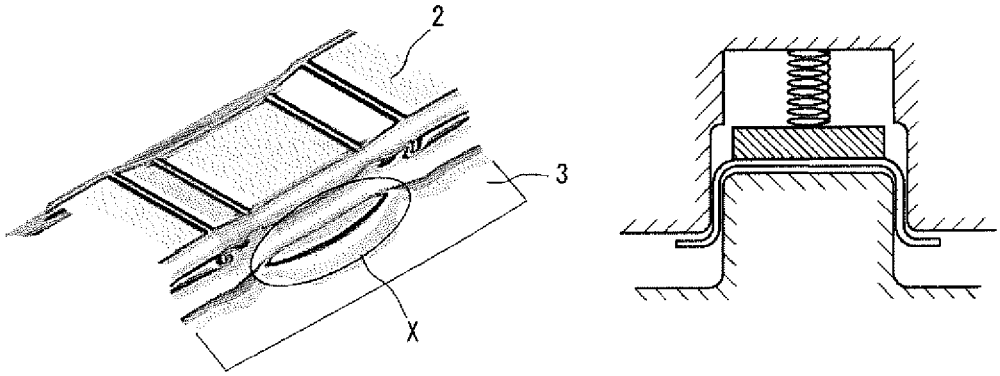
FIG. 4 shows the shape of the processed material in an intermediate stage of the press forming in the case where the press forming is performed in only one step.
Figure 5:
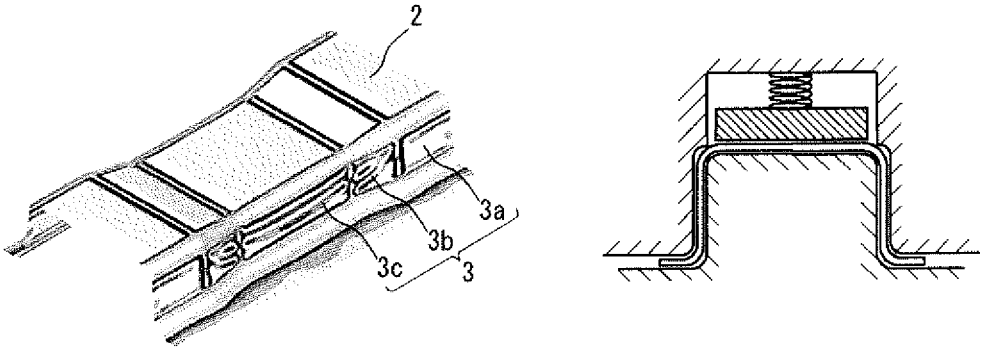
FIG. 5 shows the shape of the processed material in a completion stage of the press forming in the case where the press forming is performed in only one step.

FIGS. 3 to 5 show results of the simulation in the case where the press-formed product shown in FIG. 1 was formed in one bend forming process. FIGS. 3 and 4 show the shape of the processed material during the press forming. FIG. 3 shows an initial stage of the press forming. FIG. 4 shows an intermediate stage of the press forming. FIG. 5 shows the stage at the time of completion of the press forming. FIGS. 3 to 5 further show a cross section of press tooling in the stages described above for ease of understanding.

In FIGS. 3 and 4, an area where an excess material occurs and the degree of restriction imposed by upper and lower die sets is small is defined as an area X. The area X is also an area that forms the vertical wall sections 3*b* immediately below the stepped sections and the vertical wall sections 3*c* immediately below the portion below the stepped sections when the bottom dead center in the forming is reached (see FIG. 5). On the other hand, the vertical wall sections 3*a* immediately below the portion above the stepped sections do not fall within the area X because no excess material occurs thereon. The flange sections, which are plate end sections, do not fall within the area X because no excess material occurs thereon. When a large amount of excess material occurs in the area X, the wrinkles occur. The wrinkles tend to occur particularly in the vertical wall sections 3*b* immediately below the stepped sections because the vertical wall sections 3*b* are deformed to absorb the excess material (shear deformation) during the forming process.

Figure 6:
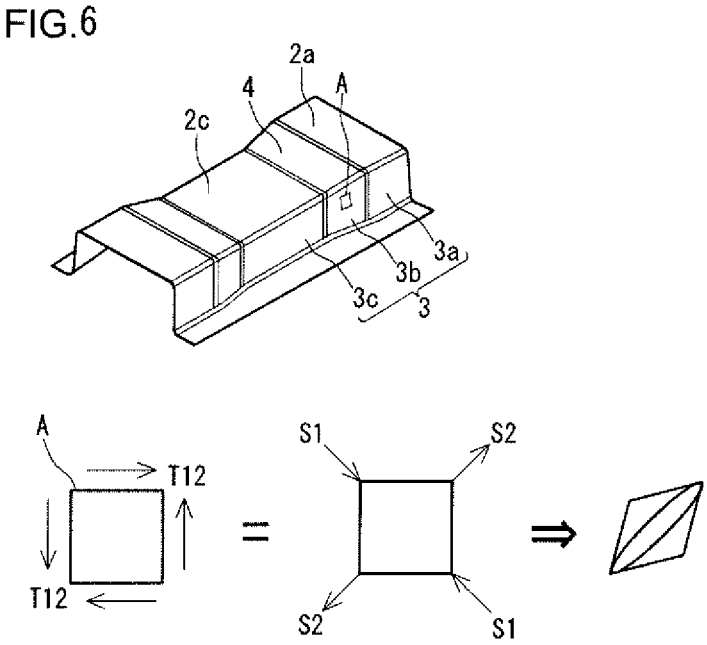
FIG. 6 diagrammatically shows stress acting on a minute element of a vertical wall section immediately below the stepped sections (inclining sections).

FIG. 6 diagrammatically shows the state of stress acting on the vertical wall sections immediately below the stepped sections of the press-formed product according to the present embodiment. In the formation of the press-formed product, shearing stress 112 acts in the in-plane direction of the processed material on a minute element A of the vertical wall sections 3*b* immediately below the stepped sections because the minute element A absorbs the excess material having occurred in the area X. The shearing stress T12, when expressed in the form of primary stress, is decomposed into compression stress S1 and tensile stress S2. The square minute element A, when the stress acts thereon, is deformed into a parallelogram. In other words, the minute element A undergoes shearing deformation. Shearing strain is therefore induced in the minute element A. The shearing strain is one factor that makes the wrinkles of the press-formed product worse.

The degree of the wrinkles attributable to the excess material that occurs when a hat-shaped press-formed product having stepped sections is press-formed depends on the width of the top plate section. In a case where the width W2 of the top plate section below the stepped sections (see FIG. 1) is three times the radius of curvature R of the ridge sections or less (W2≤3R), the wrinkles are unlikely to occur because the tensile stress in the width direction of the press-formed product effectively acts. On the other hand, in a case where the width W2 of the top plate section is greater than three times the radius of curvature R of the ridge sections (W2>3R), the wrinkles are likely to occur. The radius of curvature R means the radius of curvature around the center of the plate thickness of the ridge sections, which are widthwise end sections of the stepped sections, in a cross section perpendicular to the longitudinal direction.

The degree of the wrinkles attributable to the excess material that occurs when the hat-shaped press-formed product having stepped sections is press-formed further depends on the plate thickness of the processed material. A reason for this is that the plate thickness of the processed material determines the bending rigidity of the processed material. The smaller the plate thickness is, the more probably the wrinkles occur.

The degree of the wrinkles attributable to the excess material that occurs when the hat-shaped press-formed product having stepped sections is press-formed still further depends on the yield strength of the processed material. A reason for this is that the excess material occurs in the press forming due to out-of-plane deformation under an elastic deformation condition. The higher the yield strength of the processed material is, the more probably the wrinkles occur.

The present inventors have examined a method for reducing the excess material in the area X that occurs during the formation of the press-formed product 1 and the shearing strain induced in the vertical wall sections 3*b* immediately below the stepped sections to avoid the wrinkles that occur on the vertical wall sections 3*b* immediately below the stepped sections and the vertical wall sections 3*c* immediately below the portion below the stepped sections of the press-formed product 1, and the present inventors have attained the following findings:

To avoid occurrence of the wrinkles, it is essential to minimize elastic out-of-plane deformation when the ridge sections, which are end portions of the stepped sections formed by the out-of-plane deformation, are formed. In other words, the ridge sections may be caused to actively undergo plastic deformation to minimize the out-of-plane deformation that increases as the press forming advances.

To this end, the present inventors found that it is preferable to divide the step of press-forming the press-formed product 1 into a plurality of steps. The present inventors have found that it is preferable to form, in the first pressing step, the stepped sections of the press-formed product, the ridge sections of the portions adjacent to the stepped sections, and the areas adjacent to the stepped sections via the ridge sections out of temporary vertical wall sections adjacent to the top plate section via the ridge sections and having part of the vertical wall sections. The stepped sections are desirably formed such that the entire area of the stepped sections along the ridge sections is formed, but the entire area of the stepped sections along the ridge sections is not necessarily formed. Forming part of the stepped sections is also effective in avoiding occurrence of the wrinkles. The present inventors have found that it is preferable to form, after the first pressing step, the remainder is formed in the second and the following steps. The out-of-plane deformation, which increases as the press forming advances, can be suppressed because the press tooling is temporarily separate from each other after the first pressing step. As a result, the occurrence of the wrinkles attributable to the excess material can be avoided even when a processed material having a small plate thickness and/or high strength is formed into a press-formed product having stepped sections and further having a wide top plate section.

The present inventors have subsequently conducted the FEM simulation to confirm the effect of the idea described above.

Figure 7:
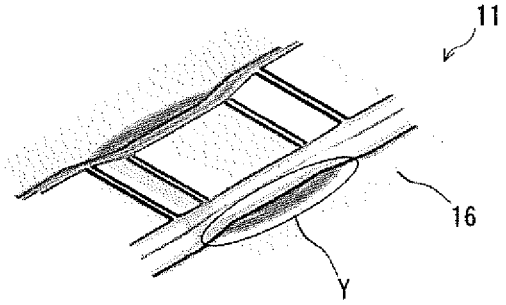
FIG. 7 shows the shape of a processed material after a first step is completed in a case where the press forming is performed in two steps.
Figure 8:
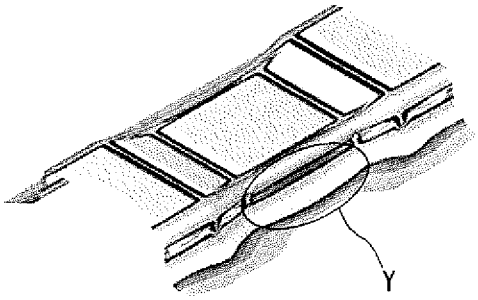
FIG. 8 shows the shape of the processed material during the press forming in a second step in the case where the press forming is performed in two steps.
Figure 9:
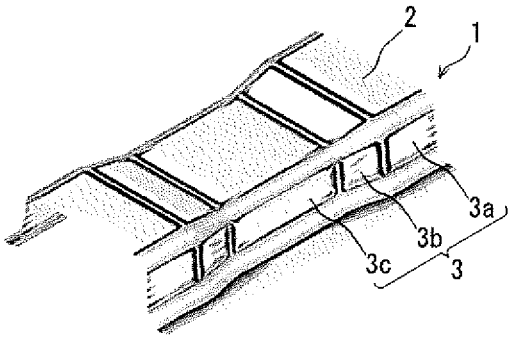
FIG. 9 shows the shape of the processed material at the time of completion of the press forming in the second step in the case where the press forming is performed in two steps.

FIGS. 7 to 9 show results of the simulation in the case where the press-formed product shown in FIG. 1 is formed in two press formation processes. FIGS. 7 to 9 show the shape of the processed material during the formation of the vertical wall sections. In the simulation shown in FIGS. 7 to 9, the top plate section and the ridge sections of the press-formed product shown in FIG. 1 are formed in the first step, and the remainder is formed in the second step. FIG. 7 shows an intermediate formed product after press forming in the first step is completed and the die sets are separated from the press-formed product. FIG. 8 shows the state during the press forming in the second step. FIG. 9 shows the press-formed product after press forming in the second step is completed. The height of the formed product in FIGS. 7 to 9 is equal to the height of the formed product in FIGS. 3 to 5.

The amount of the excess material of the processed material in an area Y (corresponding to area X in FIG. 3) of temporary flange sections 16 of an intermediate formed product 11 was smaller than the amount in the case shown in FIG. 3, as shown in FIG. 7. The intermediate formed product 11 formed in the first step was then press-formed in the second step into the press-formed product 1. The wrinkles detected from the primary curvature thereof on the vertical wall sections 3*b* immediately below the stepped sections and the vertical wall sections 3*c* immediately below the portion below the stepped sections of the press-formed product 1 were markedly reduced, as shown in FIG. 9, as compared with the wrinkles of the press-formed product shown in FIG. 5. This point will be described with reflectance to FIG. 10.

Figure 10:
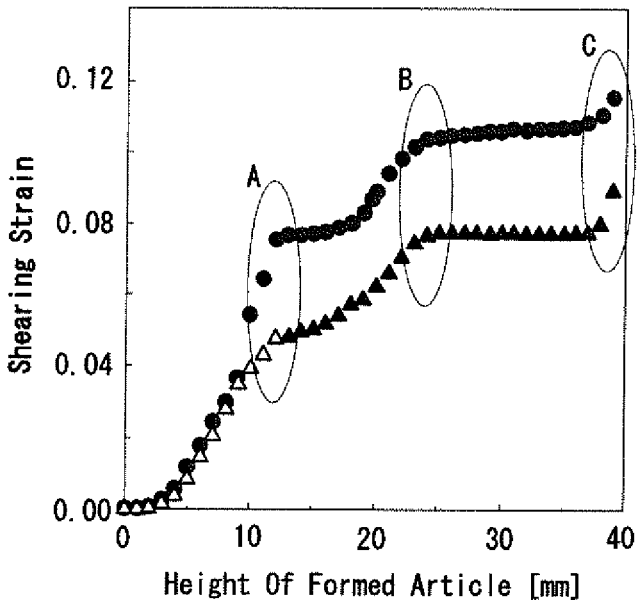
FIG. 10 shows the magnitude of shearing strain in the course of the press forming.

FIG. 10 shows the magnitude of shearing strain at an arbitrary point on the vertical wall sections 3*b* immediately below the stepped sections in the course of the press forming. The ordinate of FIG. 10 represents the magnitude of the shearing strain, and the abscissa of FIG. 10 represents the height of the formed vertical wall sections 3*a* immediately below the portion above the stepped sections. The filled circular marks in FIG. 10 represent results in the case where the forming was performed in one pressing step. The open triangular marks in FIG. 10 represent results of the first step out of results in the case the forming was performed in the two pressing steps. The filled triangular marks in FIG. 10 represent results of the second step out of the results in the case the forming was performed in the two pressing steps. An area A in FIG. 10 represents the point of time when the height of the formed product is approximately 10 mm and corresponds to the states in FIGS. 3 and 7. An area B in FIG. 10 represents the point of time when the height of the formed product is approximately 23 mm and corresponds to the states in FIGS. 4 and 8. An area C in FIG. 10 corresponds to the states in FIGS. 5 and 9.

In the area A in FIG. 10, the shearing strain is about 0.08 in the case where the forming was performed in one pressing step (filled circular marks), whereas the shearing strain is about 0.05 in the case where the forming was performed in two pressing steps (open triangular marks). A reason for this is that in the case where the forming was performed in two pressing steps, the shearing strain was suppressed by the formation of the intermediate formed product including the temporary flange sections. After the press forming further advances from the point of time of the area A, the magnitude of the shearing strain changes in the same manner both in the case where the forming was performed in one pressing step and the case where the forming was performed in two pressing steps. In short, the formation of the temporary flange sections suppresses the shearing strain in the vertical wall sections 3*b* immediately below the stepped sections, as shown in the area A in FIG. 10. As a result, the shearing strain in the final product is suppressed. That is, the size of the wrinkles decreases.

A method for producing a press-formed product according to the present embodiment was attained based on the findings described above. The method for producing a press-formed product according to the present embodiment will be described below.

The method for producing a press-formed product according to the present embodiment includes a first pressing step and a second pressing step. In the first pressing step, a first press tooling is used to form the intermediate formed product from a processed material. In the second pressing step, a second press tooling is used to form the intermediate formed product formed in the first pressing step into a press-formed product.

[Intermediate Formed Product]

Figure 11:
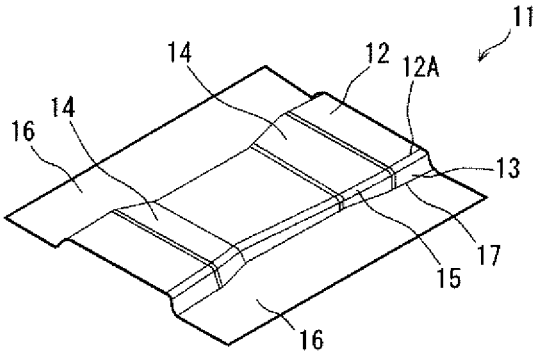
FIG. 11 is a perspective view of an intermediate formed product produced in a first pressing step.

FIG. 11 is a perspective view of the intermediate formed product produced in the first pressing step. The intermediate formed product 11 includes a top plate section 12, ridge sections 15, temporary vertical wall sections 13, temporary ridge sections 17, and temporary flange sections 16. The top plate section 12 of the intermediate formed product 11 has the same shape as that of the top plate section 2 of the press-formed product 1 (finished product) shown in FIG. 1. The top plate section 12 of the intermediate formed product 11 therefore includes stepped sections 14. The ridge sections 15 are located in widthwise end sections 12A of the top plate section 12.

Figure 19:
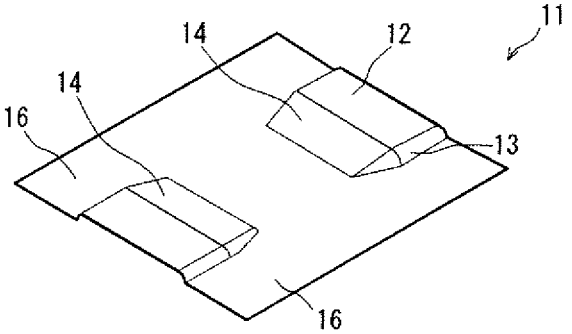
FIG. 19 is a perspective view showing an intermediate formed product in Inventive Example of the present invention.

The temporary vertical wall sections 13 have at least part of the shape of the vertical wall sections of the press-formed product. In other words, the temporary vertical wall sections 13 have a halfway shape of the vertical wall sections of the press-formed product. The temporary vertical wall sections 13 are adjacent to the top plate section 12 via the ridge sections 15. The angle between the temporary vertical wall sections 13 and the top plate section 12 is typically the right angle or an obtuse angle that allows separation from the press tooling. The temporary ridge sections 17 exist in end sections of the temporary vertical wall sections 13 that are the end sections opposite to the ridge sections 15. The temporary flange sections 16 are adjacent to the temporary vertical wall sections 13 via the temporary ridge sections 17. The intermediate formed product may not include the top plate section 2*c* below the stepped sections, the ridge sections adjacent to the top plate section 2*c* below the stepped sections, or the temporary vertical wall sections adjacent to the top plate section 2*c* below the stepped sections via the ridge sections, which exist in the press-formed product in FIG. 1, as shown in FIG. 19.

[First Press Tooling]

Figure 12:
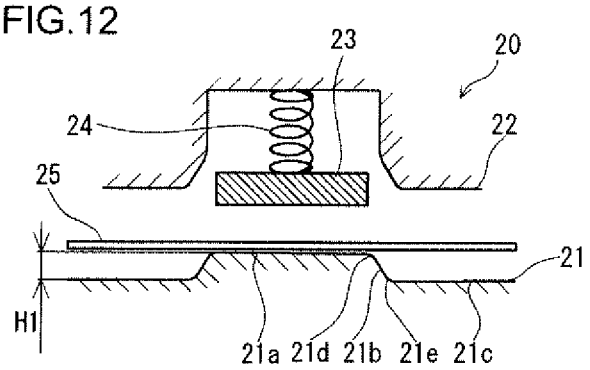
FIG. 12 shows the state before forming in the first pressing step starts.
Figure 13:
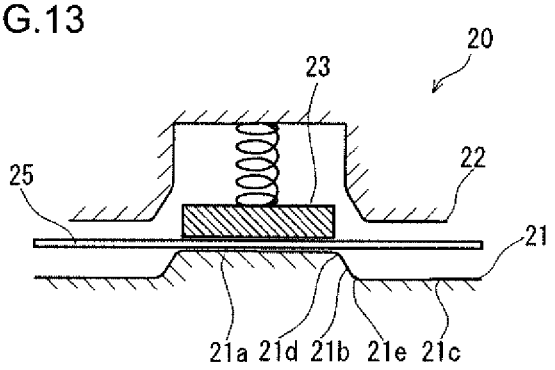
FIG. 13 shows an initial state of the forming in the first pressing step.
Figure 14:
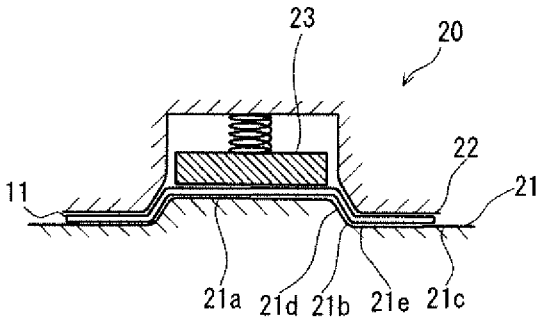
FIG. 14 shows the state at the time of completion of the forming in the first pressing step.

FIGS. 12 to 14 are cross-sectional views stepwisely showing how a metal plate 25 is formed into the stepped sections 14 in the first pressing step. Out of the figures, FIG. 12 shows the arrangement of press tooling and a processed material before the forming starts. FIG. 13 shows an initial state of the forming. FIG. 14 shows the state after the forming is completed.

First press tooling 20 includes a first punch 21 as a lower die set and a first die 22 and a first pad 23 as an upper die set, as shown in FIGS. 12 to 14. That is, the first punch 21 faces the first die 22 and the first pad 23. The first press tooling 20 forms the metal plate 25 into the intermediate formed product 11 shown in FIG. 11.

The first punch 21 includes a first top section 21*a*, first punch wall sections 21*b*, and punch flat sections 21*c*. The first top section 21*a* includes a stepped section in a longitudinal direction that extends from a widthwise end section of the first punch 21 and crosses at least widthwise part of the first punch 21. That is, the shape of the first top section 21*a* of the first punch 21 corresponds to the top plate section of the intermediate formed product. The first punch wall sections 21*b* are adjacent to the first top section 21*a* via first punch shoulders 21*d*, which are located in end sections of the first top section 21*a* that are end sections where stepped sections exist. That is, the shape of the first punch wall sections 21*b* corresponds to the temporary vertical wall sections of the intermediate formed product. The first punch shoulders 21*d* have shapes corresponding to the ridge sections of the intermediate formed product. The punch flat sections 21*c* are adjacent to the first punch wall sections 21*b* via punch bottom shoulders 21*e*. That is, the shape of the punch flat sections 21*c* corresponds to the temporary flange sections of the intermediate formed product. The shape of the punch bottom shoulders 21*e* corresponds to the temporary ridge sections of the intermediate formed product.

The first die 22 faces the first punch shoulder 21*d*, the first punch wall sections 21*b*, and the punch flat sections 21*c* of the first punch 21. The first die 22 and the first punch 21 form an area of the intermediate formed product excluding the top plate section.

The first pad 23 faces the first top section 21*a* of the first punch 21. The first pad 23 and the first punch 21 form the top plate section of the intermediate formed product. The first pad 23 is attached to the first die 22 via a pressurizing member 24. The pressurizing member 24 is, for example, a spring, a rubber block, or a hydraulic cylinder.

Figure 23:
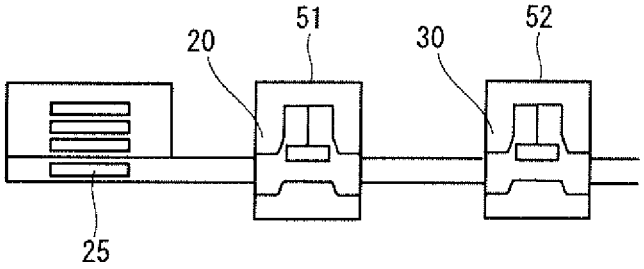
FIG. 23 shows a production line according to the present embodiment.

The first press tooling 20 is installed in a first press machine 51 (see FIG. 23). The first press machine 51 causes the metal plate 25 to undergo pad bend forming. The first pressing step performed by the first press machine in which the first press tooling has been installed will be described below.

[First Pressing Step]

In the first pressing step, the metal plate 25 is used as a processed material (blank material), as shown in FIGS. 12 to 14. The metal plate 25 is, for example, a high-strength steel plate having tensile strength of 590 MPa or more, desirably 980 MPa or more. Since a high-strength processed material has a high yield point, wrinkles tend to occur. The production method according to the present embodiment is suitable for press forming of such a high-strength processed material. The metal plate 25 can instead be a plated steel plate, a stainless steel plate, an alloy steel plate, an aluminum alloy plate, a copper alloy plate, or any other suitable plate. The present disclosure is also applicable to a softened plastic sheet as well as a metal plate.

The metal plate 25 is placed in a predetermined position on the first punch 21, as shown in FIG. 12. The metal plate 25 is placed so as to be in contact with the first top section 21*a* and the first punch shoulders 21*d*. The metal plate 25 is further disposed between the punch flat sections 21*c* and the first die 22. The first pad 23 and the first die 22 then approach the first punch 21. The state shown in FIG. 13 is thus achieved.

The first pad 23 and the first top section 21*a* of the first punch 21 sandwich the metal plate 25, as shown in FIG. 13. The first pad 23 desirably does not press a location of the metal plate 25 that is the location formed into the ridge sections. That is, the first pad 23 and the punch shoulders desirably do not sandwich the metal plate 25. The configuration described above can avoid occurrence of the wrinkles. The first pad 23 most desirably presses the metal plate 25 in such a way that the first pad 23 reaches the vicinity of the location where the ridge sections are formed. When the first die 22 further approaches the first punch 21, the first punch 21 starts pushing the metal plate 25 toward the first die 22, and the metal plate 25 starts undergoing bend forming. When the first die 22 further approaches the first punch 21, the pushing action of the first punch 21 toward the first die 22 reaches the bottom dead center, and the state shown in FIG. 14 is achieved.

When the bottom dead center in the forming process is reached, the intermediate formed product 11 is produced, as shown in FIG. 14.

With reference to FIG. 11, in the first pressing step, forming the temporary flange sections 16 allows the excess material in the area X (see FIG. 3) in the formation of the temporary vertical wall sections 13 to be restricted and the excess material in the area X to be crushed by the press tooling at the bottom dead center in the forming process. As a result, no excess material will exists in the area X. Further, in the first pressing step, when the intermediate formed product is separated from the press tooling, the elasticity of the processed material is recovered. The recovery of the elasticity can also reduce the shearing strain induced in the vertical wall sections 3*b* immediately below the stepped sections.

The height of the formed vertical wall sections 3*a* immediately below the portions above the stepped sections of the intermediate formed product formed in the first pressing step is preferably 50% the height of the formed vertical wall sections of the press-formed product, which is the final product, or less. That is, the height of the temporary vertical wall sections of the intermediate formed product is preferably 50% the height of the vertical wall sections of the press-formed product or less. The height of the vertical wall sections of the press-formed product means the height of the vertical wall sections 3*a* immediately below the portions above the stepped sections. Most preferably, the entire area of the ridge sections of the press-formed product is formed in the first pressing step. The shearing strain in the vertical wall sections 3*a* immediately below the portions above the stepped sections sharply increases when the ridge sections of the press-formed product are formed, as shown in the area A in FIG. 10. A reason for this is that the shearing strain can be greatly reduced by the formation of the intermediate formed product with the entire area corresponding to the ridge sections of the press-formed product formed in the first pressing step. Further, it is most preferable that no temporary vertical wall sections adjacent to the top plate section 2*c* below the stepped sections is formed.

The first pressing step has been described with reference to the case where the processed material undergoes bend forming. The first pressing step is, however, not limited to bend forming. In the first pressing step, the intermediate formed product may be formed in draw forming.

Figure 15:
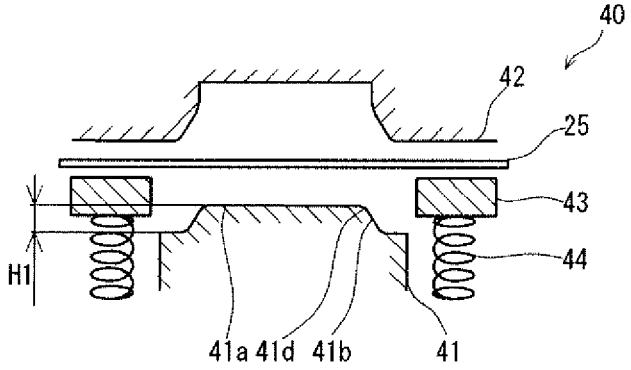
FIG. 15 is a cross-sectional view showing first press tooling in a case where draw forming is performed in the first pressing step.

FIG. 15 is a cross-sectional view showing the first press tooling in a case where draw forming is performed in the first pressing step. First press tooling 40 includes a first punch 41 and blank holders 43 as the lower die set and a first die 42 as the lower die set. That is, the first die 42 faces the first punch 41 and the blank holders 43. The first press tooling 40 forms the metal plate 25 into the intermediate formed product 11 shown in FIG. 11.

The first punch 41 includes a first top section 41*a* and first punch wall sections 41*b*. The first top section 41*a* includes a stepped section in a longitudinal direction that extends from a widthwise end section of the first punch 41 and crosses at least widthwise part of the first punch 41. That is, the shape of the first top section 41*a* of the first punch 41 corresponds to the top plate section of the intermediate formed product. The first punch wall sections 41*b* are adjacent to the first top section 41*a* via first punch shoulders 41*d*, which are located in end sections of the first top section 41*a* that are end sections where stepped sections exist. That is, the shape of the first punch wall sections 41*b* corresponds to the shape of the temporary vertical wall sections of the intermediate formed product. The shape of the first punch shoulders 41*d* corresponds to the shape of the ridge sections of the intermediate formed product.

The blank holders 43 are disposed so as to be adjacent to the first punch 41. The blank holders 43 face the first die 42. The blank holders 43 and the first die 42 form the temporary flange sections of the intermediate formed product. The shape of the blank holders 43 corresponds to the shape of the temporary flange sections of the intermediate formed product. The blank holders 43 are attached to a press machine that is not shown via pressurizing member 44. The pressurizing members 44 are each, for example, a spring, a rubber block, or a hydraulic cylinder.

The first die 42 faces the first punch 41 and the blank holders 43. The first die 42, the first punch 41, and the blank holders 43 form the intermediate formed product. The shape of the first die 42 therefore corresponds to the shape of the intermediate formed product.

In the case where the first pressing step is draw forming, the blank holders 43 and the first die 42 first sandwich the metal plate 25. The first punch 41 is then pushed toward the first die 42 to produce the intermediate formed product.

In short, in the first pressing step, the first press tooling 20 shown in FIG. 12 or the first press tooling 40 shown in FIG. 15 can be used.

With reference to FIG. 23, in the production method according to the present embodiment, after the first pressing step, the second pressing step is carried out. Second press tooling 30 is placed in a second press machine 52. The second pressing step will be described below.

[Press-Formed Product]

The press-formed product produced in the second pressing step is a press-formed product with a top plate section having stepped sections, such as that shown in FIG. 1.

[Second Press Tooling]

Figure 16:
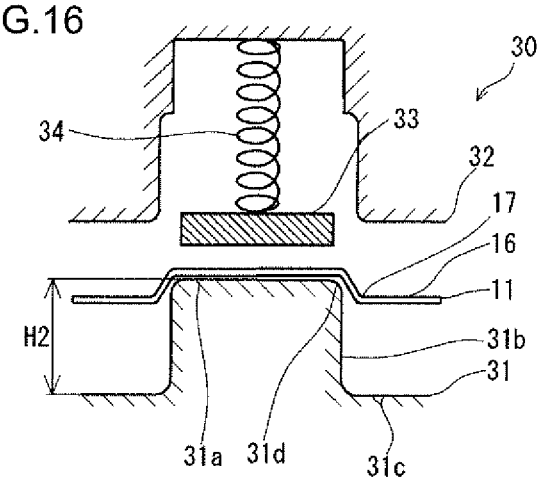
FIG. 16 shows the state before forming in the second pressing step starts.
Figure 17:
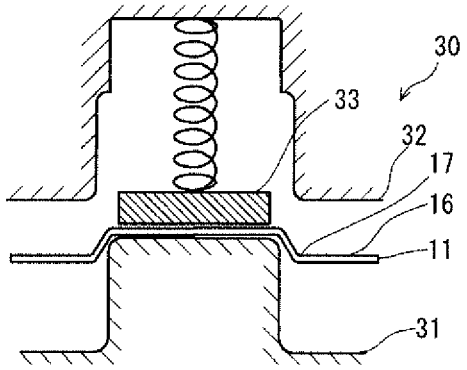
FIG. 17 shows an initial state of the forming in the second pressing step.
Figure 18:
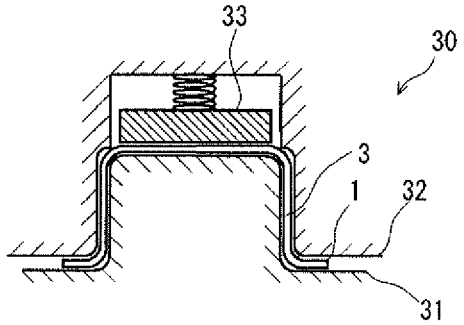
FIG. 18 shows the state at the time of completion of the forming in the second pressing step.

FIGS. 16 to 18 are cross-sectional views stepwisely showing the second pressing step. Out of the figures, FIG. 16 shows the state before the forming starts. FIG. 17 shows an initial state of the forming. FIG. 18 shows the state at the time of completion of the forming.

Second press tooling 30 includes a second punch 31 as a lower die set and a second die 32 and a second pad 33 as an upper die set, as shown in FIGS. 16 to 18. That is, the second punch 31 faces the first die 32 and the first pad 33. The second press tooling 30 forms the intermediate formed product 11 produced in the first pressing step into the press-formed product 1 shown in FIG. 1.

The second punch 31 includes a second top section 31*a* and second punch wall sections 31*b*. The shape of the second top section 31*a* is the same as the shape of the first top section 21*a* of the first punch 21 of the first press tooling 20 (see FIG. 12). That is, the shape of the second top section 31*a* corresponds to the shape of the top plate section of the press-formed product. The second punch wall sections 31*b* are adjacent to the second top section 31*a* via second punch shoulders 31*d*, which are located in end sections of the second top section 31*a* that are end sections where stepped sections exist. That is, the shape of the second punch wall sections 31*b* corresponds to the shape of the vertical wall sections of the press-formed product. The shape of the second punch shoulders 31*d* corresponds to the shape of the ridge sections of the press-formed product.

The second die 32 faces the second punch shoulders 31*d* and the second punch wall sections 31*b* of the second punch 31. The second die 32 and the second punch 31 form the area of the press-formed product excluding the top plate section. The shape of the second die 32 therefore corresponds to the shape of the second punch 31.

The second pad 33 faces the second top section 31*a* of the second punch 31. The second pad 33 and the second punch 31 form the top plate section of the intermediate formed product. The shape of the second pad 33 therefore corresponds to the shape of the second top section 31*a* of the second punch 31. The second pad 33 is attached to the second die 32 via a pressurizing member 34. The pressurizing member 34 is, for example, a spring, a rubber block, or a hydraulic cylinder.

The second press tooling 30 is placed in the second press machine that is not shown. The second press machine causes the intermediate formed product to undergo pad bend forming. The second pressing step performed by the second press machine in which the second press tooling has been installed will be described below.

[Second Pressing Step]

The intermediate formed product 11 formed in the first pressing step is placed in a predetermined position on the second punch 31, as shown in FIG. 16. The second pad 33 and the second die 32 then approach the second punch 31. The state shown in FIG. 17 is thus achieved.

The second pad 33 and the second punch 31 sandwich the top plate section of the intermediate formed product 11, as shown in FIG. 17. The intermediate formed product 11 is thus restricted. The second pad 33 and the second punch 31 may restrict the entire area of the top plate section of the intermediate formed product 11 or may restrict part of the area. The area where the intermediate formed product 11 is restricted is set as appropriate in consideration of the occurrence of the wrinkles, the dimension accuracy of the formed product, and other factors.

When the second die 32 further approaches the second punch 31, the second punch 31 starts pushing the intermediate formed product 11 toward the second die 32, and the intermediate formed product 11 starts undergoing bend forming. In the second pressing step, the intermediate formed product 11 is formed such that the temporary ridge section 17 thereof is moved toward the temporary flange sections 16. That is, the temporary flange sections 16 are successively bent by the die shoulders of the second die and then extended between the second die 32 and the second punch 31. The temporary flange sections 16 are thus formed into the vertical wall sections 3 of the press-formed product 1. When the second die 32 further approaches the second punch 31, the pushing action of the second punch 31 toward the second die 32 reaches the bottom dead center, and the state shown in FIG. 18 is achieved.

When the bottom dead center in the forming process is reached, the press-formed product 1 is produced, as shown in FIG. 18.

In the second pressing process, to form the temporary flange sections 16 into the vertical wall sections 3, the temporary ridge sections between the temporary vertical wall sections 13 and the temporary flanges 16 are moved toward the flange. Since the position of the temporary ridge sections is moved at the same height irrespective of the shape of the top plate section, no excess material is likely to occur in the second pressing step. Further, when the temporary ridge sections are moved in the second pressing step, tensile force is induced in the temporary vertical wall sections 13, whereby the excess material having occurred in the first pressing step decreases. As a result, no wrinkles occur on the vertical wall sections 3*b* immediately below the stepped sections and the vertical wall sections 3*c* immediately below the portion below the stepped sections of the press-formed product 1.

The height H2 (see FIG. 16) of the second punch wall sections 31*b* in the second press machine (second press tooling 30) is greater than the height H1 (see FIG. 12) of the first punch wall sections 11*b* and 31*b* in the first press machine (first press tooling 10 and 30). In other words, the height of the formed product in the second pressing step is greater than the height of the formed product in the first pressing step. The intermediate formed product formed in the first press machine includes the temporary flange sections. The configuration described above allows a high-strength steel plate to be formed into a press-formed product, such as that shown in FIG. 1, with no wrinkle.

After the second pressing step, a hole may be created in the press-formed product, and a trimming step of cutting an unnecessary portion off the press-formed product may be carried out.

Further, needless to say, the present disclosure is not limited to the embodiment described above and can be changed in a variety of manners to the extent that the changes do not depart from the substance of the present disclosure. For example, the press forming apparatus in the embodiment described above includes a punch as the lower die set and a die and a pad as the upper die set. Instead, the upper and lower die sets may be reversed upside down in terms of arrangement.

EXAMPLES

To check the wrinkle avoiding effect provided by the production method according to the present embodiment, the FEM simulation was conducted. In the simulation, the tensile strength acting on the processed material was changed to a variety of values. In the simulation, it was assumed that the press-formed product having the shape shown in FIG. 1 was formed. It was further assumed as Inventive Example of the present invention that the press-formed product was formed in the two pressing steps, and that a press-formed product was formed in the one pressing steps as Comparative Example. In Inventive Example of the present invention, the first pressing step was carried out to form a processed material that is a flat steel plate by using the first press tooling, and the second pressing step was carried out by using the second press tooling.

FIG. 19 is a perspective view showing an intermediate formed product in Inventive Example of the present invention. In the first pressing step in Inventive Example of the present invention, an intermediate formed product 11 shown in FIG. 19 was formed. The intermediate formed product 11 includes a top plate section 12 having stepped sections 14, temporary vertical wall sections 13, and a temporary flange section 16. In the second pressing step in Inventive Example of the present invention, the intermediate formed product 11 is formed into the press-formed product shown in FIG. 1.

The dimensions of the press-formed product formed in Inventive Example of the present invention will be described. The width W1 of the top plate section above the stepped sections of the press-formed product was set at 90 mm (see FIG. 1). The width W2 of the top plate section below the stepped sections of the press-formed product was set at 80 mm. The height H1 of the formed top plate section above the stepped sections of the press-formed product was set at 40 mm. The height H2 of the formed top plate section below the stepped sections of the press-formed product was set at 35 mm. That is, the height H of the stepped sections was set at 5 mm. The radius of curvature R of the ridge sections of the press-formed product was set at 6 mm.

The processed materials used in the formation experiment in the present example were steel plates corresponding to JAC270DC, JAC590R, JSC980Y, and JAC1180Y defined in the Japan Iron and Steel Federation standard. That is, the tensile strength of JAC270DC was 270 MPa. The tensile strength of JAC590R was 590 MPa. The tensile strength of JSC980Y was 980 MPa. The tensile strength of JAC1180Y was 1180 MPa.

A study was conducted on the primary curvature $1/\rho$ at an arbitrary point on the vertical wall sections 3*c* immediately below the portion below the stepped sections of each of the press-formed products formed in Inventive Example of the present invention and Comparative Example. The difference $\Delta 1/\rho$ between the maximum and minimum of the primary curvature $1/\rho$ was calculated and used as an index of the evaluation of the wrinkles. A three-dimensional shape measurement apparatus (such as COMET V manufactured by Steinbichler Optotechnik GmbH) was used to collect image data on a finished product and image processing software (JSTAMP-NV manufactured by JSOL Corp., for example) was used to calculate $\Delta 1/\rho$.

Figure 20:
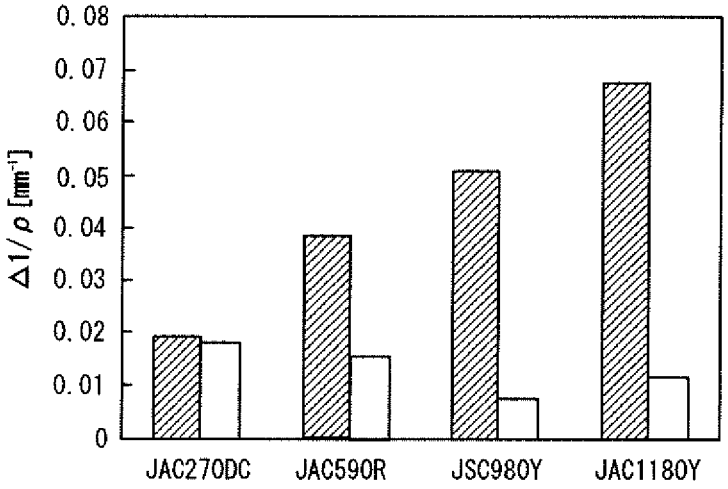
FIG. 20 shows results obtained in Inventive Example of the present invention and Comparative Example.

FIG. 20 shows results obtained in Inventive Example of the present invention and Comparative Example. The ordinate of FIG. 20 represents the difference $\Delta 1/\rho$ between the maximum and minimum of the primary curvature. Out of the bar graphs shown in FIG. 20, open bars represent the results obtained in Inventive Example of the present invention, and hatched bars represent the results obtained in Comparative Example.

In a case where the tensile strength of the processed material was 590 MPa or higher, $\Delta 1/\rho$ in Inventive Example of the present invention was remarkably smaller than that in Comparative Example. That is, in the case where the tensile strength of the processed material is 590 MPa or more, occurrence of the wrinkles in Inventive Example of the present invention was remarkably suppressed as compared with Comparative Example. Even in the case where the tensile strength of the processed material was 270 MPa, $\Delta 1/\rho$ in Inventive Example of the present invention was smaller than that in Comparative Example. Therefore, even in the case where tensile strength of the processed material was 590 MPa or less, the wrinkles of the press-formed product can be avoided in Inventive Example of the present invention.

REFERENCE SIGNS LIST

1 Press-formed product
2 Top plate section
3*a* Vertical wall section immediately below portion above stepped section
3*b* Vertical wall section immediately below stepped section
3*c* Vertical wall section immediately below portion below stepped section
4 Stepped section
5 Ridge section
6 Flange section
11 Intermediate formed product
12 Top plate section (intermediate formed product)
13 Temporary vertical wall section
14 Stepped section (intermediate formed product)
15 Ridge section (intermediate formed product)
16 Temporary flange section
17 Temporary ridge section
20 First press tooling
21 First punch
22 First die
23 First pad
24 Pressurizing member
25 Processed material
30 Second press tooling
31 Second punch
32 Second die
33 Second pad
51 First press machine
52 Second press machine

The invention claimed is:

1. A method for producing a press-formed product including a top plate section having an inclined area that extends longitudinally to connect a first area and a second area, the second area being below the first area and a vertical wall section adjacent to the top plate section via a ridge section located at an end section of the top plate section in a width direction, the method comprising:

forming an intermediate formed product from a processed material by using a first press tooling, the intermediate formed product including the top plate section, a temporary vertical wall section adjacent to the top plate section via the ridge section and having at least part of a shape of the vertical wall section, and a temporary flange section adjacent to the temporary vertical wall section via a temporary ridge section located in an end section of the temporary vertical wall section that is an end section opposite to the ridge section; and forming the press-formed product from the intermediate formed product by using a second press tooling to perform forming in which the temporary ridge section is moved toward the temporary flange section with at least part of the top plate section of the intermediate formed product restricted, wherein a height of the temporary vertical wall section adjacent to the top plate section lower than the inclined area of the intermediate formed product is 50% of a height of the vertical wall section of the press-formed product or less.

2. The method for producing a press-formed product according to claim 1, wherein tensile strength of the processed material is 590 MPa or more.

3. The method for producing a press-formed product according to claim 1, wherein tensile strength of the processed material is 980 MPa or more.

4. A method for producing a press-formed product including a top plate section having an inclined area that extends longitudinally to connect a first area and a second area, the second area being below the first area and a vertical wall section adjacent to the top plate section via a ridge section located at an end section of the top plate section in a width direction, the method comprising:

forming an intermediate formed product from a processed material by using a first press tooling, the intermediate formed product including the top plate section, a temporary vertical wall section adjacent to the top plate section via the ridge section and having at least part of a shape of the vertical wall section, and a temporary flange section adjacent to the temporary vertical wall section via a temporary ridge section located in an end section of the temporary vertical wall section that is an end section opposite to the ridge section; and forming the press-formed product from the intermediate formed product by using a second press tooling to perform forming in which the temporary ridge section is moved toward the temporary flange section with at least part of the top plate section of the intermediate formed product restricted, wherein a height H of the inclined area of the press-formed product and a radius of curvature R of the ridge section of the press-formed product satisfy a following Formula (1):

$$H \geq 0.4R \quad (1).$$

5. The method for producing a press-formed product according to claim 4, wherein a height of the temporary vertical wall section adjacent to the top plate section lower than the inclined area of the intermediate formed product is 50% of a height of the vertical wall section of the press-formed product or less.

6. The method for producing a press-formed product according to claim 4, wherein an entire area of the ridge section of the press-formed product is formed on the intermediate formed product.

7. The method for producing a press-formed product according to claim 4, wherein tensile strength of the processed material is 590 MPa or more.

8. The method for producing a press-formed product according to claim 4, wherein tensile strength of the processed material is 980 MPa or more.

* * * * *